United States Patent [19]

Wills

[11] 4,115,891

[45] Sep. 26, 1978

[54] CLEANING APPARATUS

[76] Inventor: Robert N. Wills, 5942 E. Hamilton Ave., Fresno, Calif. 93727

[21] Appl. No.: 757,203

[22] Filed: Jan. 6, 1977

[51] Int. Cl.[2] ..... A46B 13/04

[52] U.S. Cl. ..... 15/71; 134/152

[58] Field of Search ..... 15/4, 56, 59, 65, 70–76, 15/101; 134/104, 140, 152, 166, 170

[56] References Cited

U.S. PATENT DOCUMENTS

| | | | |
|---|---|---|---|
| 1,532,256 | 4/1925 | Moller | 15/56 X |
| 1,564,388 | 12/1925 | Westvig | 15/56 |
| 1,627,112 | 5/1927 | Parodi | 15/56 |
| 2,748,409 | 6/1956 | Lyman | 15/75 |
| 2,764,171 | 9/1956 | Nolte | 134/152 X |
| 2,951,490 | 9/1960 | Cuillier | 134/152 X |
| 3,240,216 | 3/1966 | Sadwith | 134/152 X |
| 3,264,675 | 8/1966 | Dillio | 15/56 UX |
| 3,890,988 | 6/1975 | Lee | 134/104 |

FOREIGN PATENT DOCUMENTS

| | | | |
|---|---|---|---|
| 1,218,501 | 12/1959 | France | 15/56 |
| 1,312,609 | 11/1962 | France | 15/75 |

*Primary Examiner*—Edward L. Roberts
*Attorney, Agent, or Firm*—Huebner & Worrel

[57] ABSTRACT

An apparatus for cleaning containers using a fluid, the apparatus having a tank adapted to receive the fluid; a shaft mount secured on the tank, having a fluid tight exterior within the tank and extending through the tank to an end portion disposed externally of the tank; a tubular shaft mounted for rotational movement on the shaft mount and having a first end portion within the tank enwardly of the shaft mount and a second end portion disposed externally of the tank; a cleaning brush affixed on the first end portion of the shaft for rotation therewith; a drive mechanism connected in driving relation to the second end portion for rotation of the shaft and the brush borne thereby; a pumping assembly interconnecting the tank and the second end portion of the shaft to pump the fluid from the tank and through the shaft to the brushes; and a container mount secured on the shaft mount within the tank for holding a container in position for cleaning by the brush.

7 Claims, 7 Drawing Figures

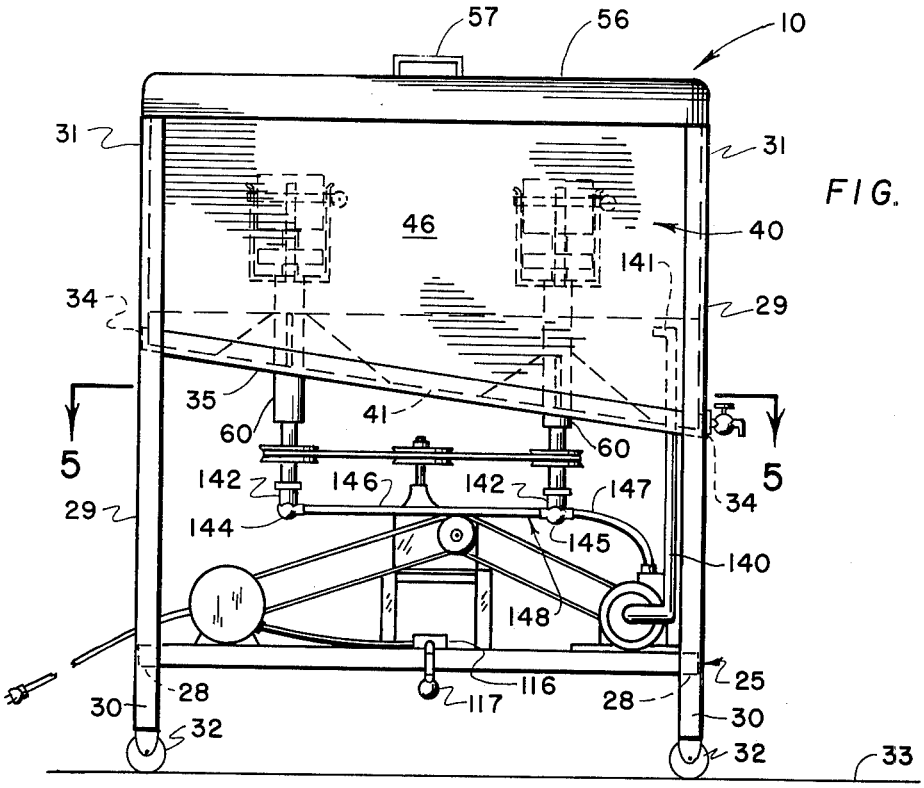
FIG. 1
FIG. 2
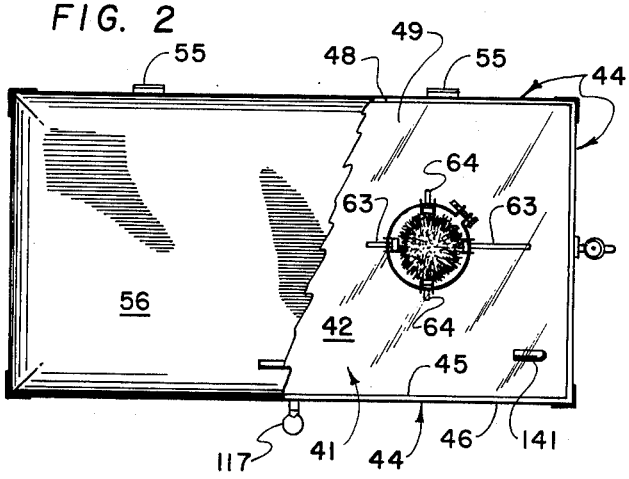
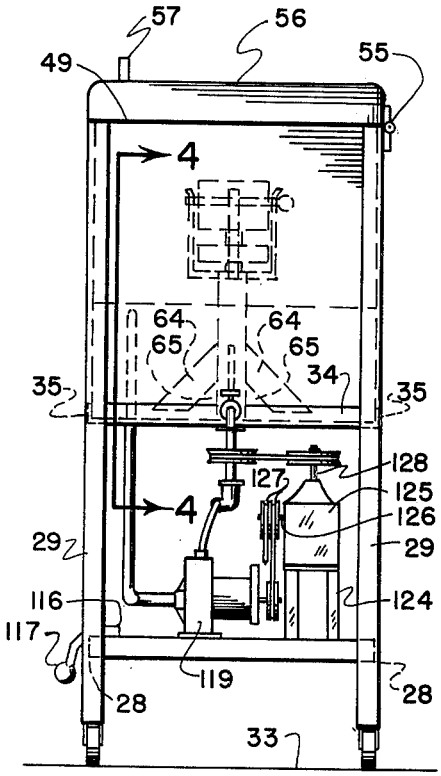
FIG. 3

CLEANING APPARATUS

BACKGROUND OF THE INVENTION

1. Field Of The Invention:

The present invention relates to a cleaning apparatus and more particularly to such a cleaning apparatus which is particularly well suited to the cleaning of containers using flamable fluids, such as paint thinner, lacquer thinner, and the like, thereby rendering reusable containers, such as paint cans, used in large quantities in many industries.

2. Description Of The Prior Art:

The prior art is typified by the devices disclosed by such U.S. Pat. as: Nos.

| | | |
|---|---|---|
| 1,173,255 | Eberhart | |
| 1,228,851 | Valerius | June 5, 1917 |
| 2,671,916 | Zipperlin | March 16, 1954 |
| 3,047,893 | Anderson | Aug. 7, 1962 |
| 3,264,675 | Di Ilio | Aug. 9, 1966 |

While it has been known to use certain types of machines to clean certain very specific types of containers, insofar as the applicant is aware there has heretofore been no machine capable of cleaning containers where the composition of the substances to be removed from the containers is such that a flammable cleaning fluid must be employed. Virtually all prior art devices have been designed to employ water as the cleaning solvent and thus are limited to such use unless excessive hazard is assumed. While water is effective on certain types of substances, such as disclosed in the prior art patents, it is entirely ineffective on substances such as paint and particularly paints of the oil or lacquer base types. In the past, the only method by which such containers could be cleaned has been by manual scrubing using a suitable cleaning solvent. In view of the highly flamable nature of such solvents used in removing substances of this type, the dangers inherent to their use, as well as the time consuming, tedious and uncleanly nature of the operation, such containers have normally been simply disposed of rather than cleaned.

In certain types of industries, such as the automotive repair industry, a considerable number of paint containers are employed on a daily basis. For example, in the automotive repair industry, large numbers of paint containers are employed to mix oil and lacquer base paints in relatively small quantities to match pre-existing painted surfaces in both color and finish. Heretofore, the containers employed in mixing even a very small quantity of paint were by necessity disposed of because of the lack of a practical method for cleaning the containers for reuse. The cost of such containers has continually risen to the point where cost of the purchase of new containers for this purpose constitutes a sizable percentage of the overall cost of the operation.

Therefore, it has long been known that it would be desirable to have a cleaning apparatus capable of cleaning containers which contain quantities of substances difficult or impossible to remove with water or similar non-flamable solvents.

SUMMARY OF THE INVENTION

Therefore, it is an object of the present invention to provide an improved cleaning apparatus.

Another object is to provide such an apparatus which is particularly well suited to the cleaning of containers using flamable fluids.

Another object is to provide such an apparatus which is operable to clean paint containers using paint thinner, lacquer thinner, or the like.

Another object is to provide such an apparatus which can be employed with flamable fluids on a routine basis while minimizing the risk of fire or explosion.

Another object is to provide such an apparatus which is operable rapidly, dependably and efficiently to clean paint containers for subsequent reuse on a daily basis.

Another object is to provide such an apparatus which permits the recovery of the cleaning solvent for subsequent reuse if desired.

Another object is to provide such an apparatus which is adaptable to the cleaning of containers of a virtually unlimited variety of shapes, sizes and types of construction.

Another object is to provide such an apparatus which retains the cleaning solvent in a sealed environment during the operation thereof to minimize the risk of fire and to avoid contamination of the environment.

A further object is to provide such an apparatus which possesses a construction resistant to damage by the cleaning solvent.

Other objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 1 is a front elevation of the cleaning apparatus of the present invention.

FIG. 2 is a fragmentary top plan view of the apparatus.

FIG. 3 is a side elevation of the apparatus.

DESCRIPTION OF THE PREFERRED EMBODIMENT

Figure 4:
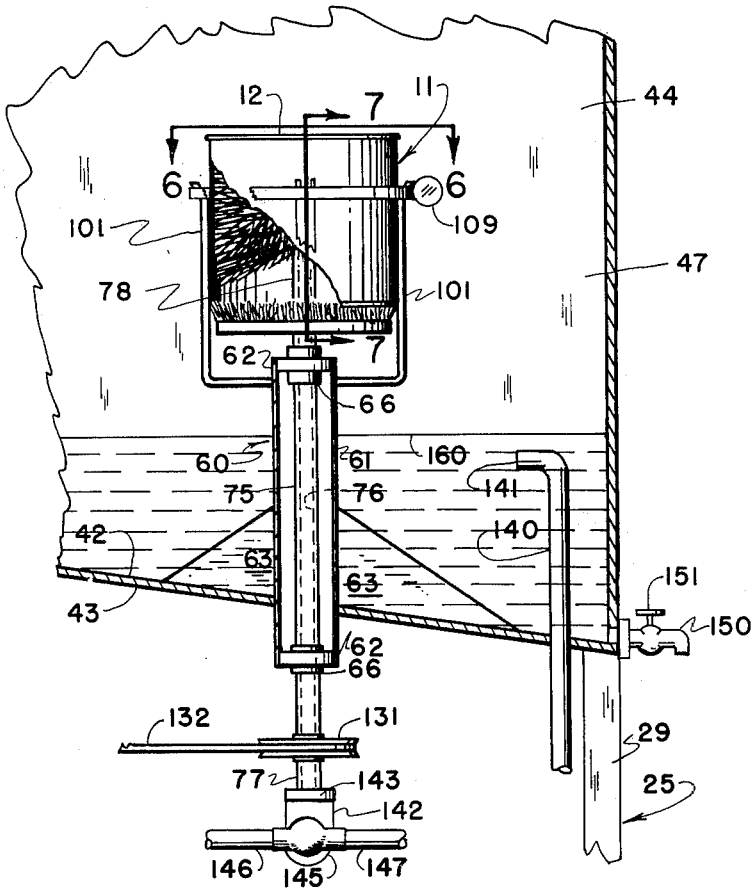
FIG. 4 is a somewhat enlarged fragmentary longitudinal vertical section taken on line 4—4 in FIG. 3.

Referring more particularly to the drawings, FIG. 1 shows the cleaning apparatus of the present invention generally indicated by the numeral 10. Although the cleaning apparatus of the present invention is adapted for use in cleaning containers of a wide variety of shapes and sizes, the apparatus has particular utility in the cleaning of containers such as container 11 which is typical of the type used in mixing paints. The container 11 has a circular bottom panel or wall 12 having an interior surface 13. A cylindrical side wall 14 is mounted on the bottom panel in the conventional manner and has an interior surface 15 and an exterior surface 16. The cylindrical side wall of the container has an annular lip 17 which defines a mouth or opening 18 for the container.

The cleaning apparatus 10 has a rigid metal frame 25. The frame has a substantially rectangular platform 26 which has a supporting surface 27 and four corners 28. The frame has four angle iron legs 29 which are individually secured, as by welding, on the corners 28 of the platform extending substantially normal to the platform and parallel to each other. Each leg has a first end portion 30 adjacent to the platform and an opposite second end portion 31. The first end portion 30 of each leg mounts a wheel assembly 32 thereon for rolling engagement with a supporting surface such as indicated at 33.

A pair of angle iron brace members 34 individually interconnect each adjacent pair of legs. The brace members on the left, as viewed in FIG. 1, is spaced farther from the platform 26 than the brace member on the right as viewed in FIG. 1. A pair of angle iron brace members 35 interconnect each remote pair of legs and extended diagonally so as to interconnect the points of connection of the brace members 34, as best shown in FIG. 1.

A tank 40 is mounted on the legs 29 and brace members 34 and 35 of the frame 25 adjacent to the second end portions 31 of the legs, as best shown in FIG. 1. The tank has a sloped floor or bottom wall 41 having an interior surface 42 and an exterior surface 43. Four side walls 44 are secured on the bottom wall and extend upwardly therefrom, as best shown in FIG. 1. Each side wall has an interior surface 45 and an exterior surface 46. The four side walls and bottom wall are sealed in fluid tight relation along their joined edges. The side walls and bottom wall define an internal receptacle 47 for the tank. The side walls have corresponding upper edges 48 which define an opening 49 providing entrance to the receptacle 47 of the tank.

A pair of hinges 55 are fastened in spaced relation on the side wall 44 on the right, as viewed in FIG. 3. A lid or closure 56 is mounted on the pair of hinges so as to be pivotal from an open position to a closed position in which it engages the upper edges 48 of the side walls in sealing relation to the receptacle of the tank. The closure has a handle 57 mounted thereon.

A pair of shaft mounts or shaft mounting assemblies 60 are borne by the bottom wall 41 of the tank 40 in spaced relation. It will become apparent that only one such mounting assembly or a plurality of mounting assemblies could be employed depending upon the number of containers preferred to be cleaned during a single operation.

Each shaft mounting assembly 60 has a cylinder or sleeve 61 mounted on and extending through the bottom wall 41 of the tank, as best shown in FIG. 4. The sleeve has opposite ends 62. One of the opposite ends, as can be seen in the drawings, is disposed within the receptacle 47 of the tank. The other opposite end 62 is disposed externally of the tank adjacent to the exterior surface 43 of the bottom wall. Each sleeve is braced in position by a pair of first brace plates 63 disposed in substantially coplanar relation and secured on the interior surface 42 of the bottom wall and oriented approximately in alignment with the slope of the bottom wall. A pair of second brace plates 64 are secured on each sleeve oriented in substantially coplanar relation transversely of the slope of the bottom wall, or, in other words, normal to the first brace plates. Each second brace plate has an opening 65 therein to permit the gravitational flow of fluids along the interior surface of the bottom wall. A pair of bearings 66 are mounted within each sleeve 61 individually adjacent to the opposite ends thereof. The bearings are sealed so as to preclude the entrance of fluids to the interiors of the sleeves.

Figure 7:
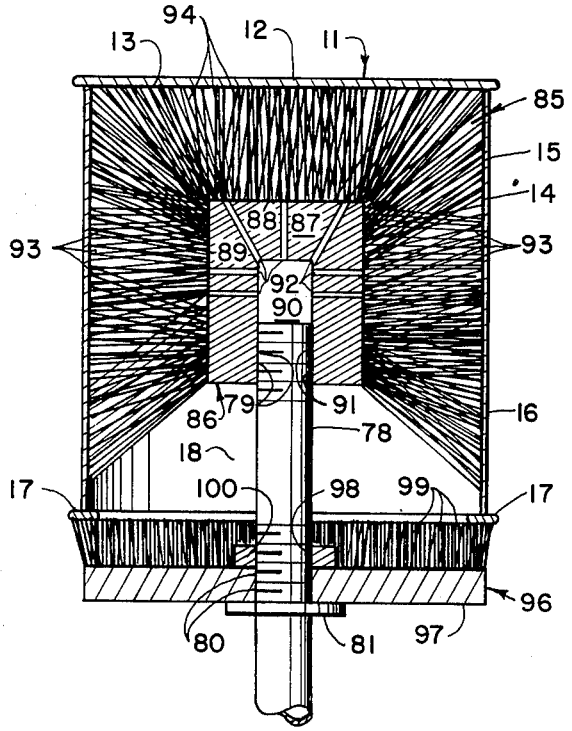
FIG. 7 is a somewhat enlarged fragmentary vertical section taken from a position indicated by line 7—7 in FIG. 4.

A tubular shaft 75 is journaled in the bearings 66 of each shaft mounting assembly 60 for rotational movement extending through its respective sleeve 61, as best shown in FIG. 4. Each tubular shaft has an axial passage 76 extending longitudinally therethrough. Each shaft has a first end portion 77 extending externally of the tank 40 and bearing and an opposite second end portion 78 extending endwardly of the bearing a predetermined distance within the receptacle 48 of the tank. First screw threads 79 are inscribed about the second end portion 78 of each shaft. Second screw threads 80 are inscribed about each shaft in predetermined spaced relation from the first screw threads, as best shown in FIG. 7. An annular stop 81 is secured on and extended about each shaft immediately adjacent to the second screw threads thereof on the opposite side of the second screw threads from the first screw threads.

A brush assembly 85 is borne by the second end portion 78 of each tubular shaft 75. Each brush assembly has a first brush 86. The first brush has a central core 87, having an end surface 88 and a substantially cylindrical surface 89. The core has a central passage 90 extending axially through the core to a position spaced from the end surface 88 of the core, as best shown in FIG. 7. The core has internal screw threads 91 inscribed about the entrance to the central passage 90 remote from the end surface 88 of the core. A plurality of spray bores 92 are extended from the cylindrical surface 89 of the core of the central passage thereof and from the end surface 88 of the core to the central passage, as best shown in FIG. 7. A multiplicity of side bristles 93 are affixed in laterally extending relation on the cylindrical surface 89 of the core. A multiplicity of end bristles 94 are affixed on the end surface of the core, as best shown in FIG. 7. The bristles are constructed of a material not subject to attack by paint thinner, lacquer thinner or the like.

Each brush assembly 85 has a second brush 96. Each second brush has a circular plate 97 preferably slightly larger in diameter than the exterior diameter of the first brush 86. The plate 97 has a screw threaded bore 98 extending axially therethrough. A multiplicity of peripheral bristles 99 are affixed on the plate 97 adjacent to the periphery thereof in upstanding relation. The plate 97 is screw threadably received on the second screw threads 80 of the tubular shaft 75 with the bristles 99 disposed facing the first brush of that brush assembly. A locknut 100 is screw threadably received on the second screw threads of the tubular shaft in binding engagement with the plate so as to lock the plate in position on the tubular shaft. It will be seen that when assembled the second brush of each brush assembly has to be mounted in position as described before its respective first brush can be mounted on the first screw threads of the tubular shaft. Rotation of each tubular shaft 75 in its respective bearings 66 causes rotation of the first and second brushes 86 and 96 therewith.

Figure 6:
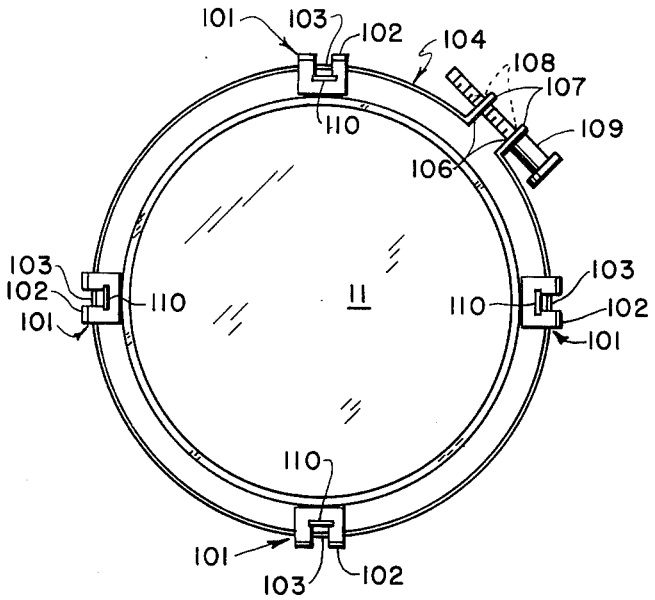
FIG. 6 is a plan view taken from a position indicated by line 6—6 in FIG. 4.

Four spring members 101 are secured, as by welding, on each sleeve 61 and extended endwardly therefrom about their respective brush assembly 85, as best shown in FIG. 4. Each spring member has an upper end 102 having a slot 103 therein. A container clamping assembly 104 is removably mounted in the slots of the spring members of each sleeve 61. Each clamping assembly has a band 105 which is resiliently formed into a substantially circular configuration. Each band has opposite ends 106 which approach each other, as best shown in FIG. 6. The opposite ends individually mount substantially radially extending flanges 107 which have screw threaded bores 108 extending therethrough. An adjustment member 109 is screw threadably received in the bores 108 to retain the flanges and thus the opposite ends 106 of the band in juxtaposition. Four studs 110 are mounted on each band for individual, slidable receipt in the slots 103 of the spring members thereby removably retaining the clamping assembly 104 in the position shown in FIGS. 4 and 6.

An electric motor 111, having an electric cable 112 with an electric plug 113 at the remote end thereof, is mounted on the platform 26 on the left, as viewed in FIG. 1. Because of the flamable nature of the fluids to be employed in the apparatus, the motor is preferably of the spark proof or explosion proof type as, for example, a Dayton Explosion Proof Motor No. 6K040. It has been found that a ¾ horsepower electric motor is sufficient for driving the pair of tubular shafts 75. The electric motor has a drive shaft 114 on which is mounted a pulley 115. A microswitch 116, operated by a foot lever 117, is secured on the platform 26. The microswitch is electrically connected to the motor by an electric cable 118. Depression of the foot lever of the microswitch operates to initiate and, alternatively, terminate operation of the electric motor.

Figure 5:
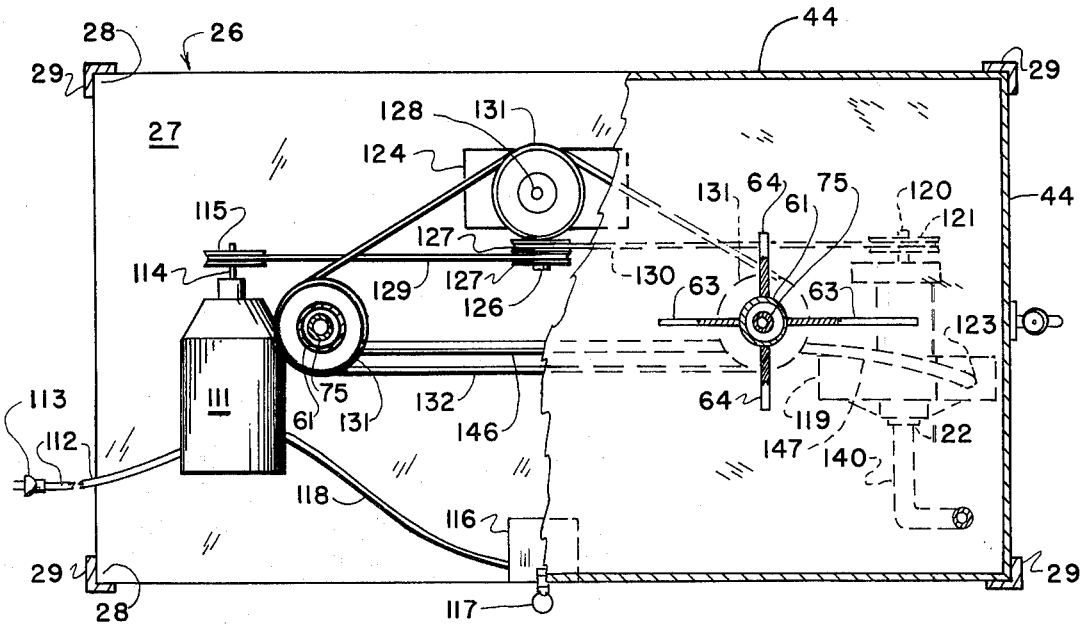
FIG. 5 is a fragmentary horizontal section taken on line 5—5 in FIG. 1.

A pump 119, such as for example a Dayton 1P534 pump head is mounted on the platform 26 on the right, as viewed in FIG. 1. The pump has a drive shaft 120 on which is mounted a pulley 121 which is in near alignment with the pulley 115 of the electric motor 111, as best shown in FIG. 5. The pump has an intake connection 122 and a discharge connection 123. An upstanding mount 124 is secured on the platform 26 between and laterally of the motor and pump. A gear box 125, such as a Winsmith Gear Box having a five to one gear ratio, is borne by the mount 124. The gear box has an input shaft 126 on which are mounted a pair of pulleys 127 for rotation with the shaft. The gear box has an output shaft 128 which extends in substantially parallel relation to the tubular shafts 75. A gear box drive belt 129 interconnects the pulley 115 of the electric motor 111 and one of the pair of pulleys 127 borne by the input shaft 126. A pump drive belt 130 interconnects the other of the pair of pulleys 127 and the pulley 121 of the pump 119, as best shown in FIG. 5. The output shaft 128 of the gear box on the first end portion 77 of each tubular shaft 75 mounts a pulley 131. The pulleys of the tubular shafts and output shaft 128 are aligned in substantially coplanar relation, as best shown in FIG. 1. A brush drive belt 132 is extended in driving relation about the pulleys 131 so that rotation of the output shaft 128 causes rotation of the tubular shafts 75.

A first conduit assembly or intake conduit 140 is extended through the bottom wall 41 of the tank 40 in fluid tight relation and has a right-angularly related intake end 141. The intake end is disposed adjacent to one of the side walls 44 of the tank and is spaced from the bottom wall 41 a predetermined distance, as best shown in FIG. 4. The opposite end of the conduit is connected to the intake connection 122 of the pump 119 in fluid supplying relation. A rotating coupling or union 142, such as a Deublin 155 rotating union, is mounted on the first end portion 77 of each tubular shaft 75. Each union has a carbide bearing 143 which is directly connected in fluid conducting relation to the first end portion of the tubular shaft. The union on the left as viewed in FIG. 1 has an elbow coupling 144 mounted thereon in fluid supplying relation. The union on the right, as viewed in FIG. 1, mounts a tee coupling 145. A pipe 146 interconnects the elbow coupling and the tee coupling. A flexible conduit 147 interconnects the tee coupling and the discharge connection 123 of the pump 119. It will be seen that during operation of the apparatus 10, fluid is pumped along the flexible conduit 147 and pipe 146 upwardly through each carbide bearing 143 into the passage 76 of each tubular shaft 75. The couplings 144 and 145 and the pipe 146 and flexible conduit 147 constitute a second conduit assembly 148.

A faucet 150 is mounted on the side wall 44 of the tank 40 on the right, as viewed in FIG. 1. The faucet is mounted on the side wall adjacent to the interior surface 42 of the bottom wall 41. The faucet has a handle 151 which can be operated to discharge fluid from the receptacle 47 of the tank 40.

OPERATION

Operation of the described embodiment of the subject invention is believed to be clearly apparent and is briefly summarized at this point.

The receptacle 47 of the tank 40 is filled with a suitable cleaning fluid or solvent depending upon the substances to be removed from the containers 11. Where the substance to be removed is paint, ordinarily paint thinner, lacquer thinner or the like is used. The receptacle 47 is filled with the cleaning solvent to a level, such as shown in FIG. 4 and identified by the numeral 160, slightly above the intake end 141 of intake conduit 140.

Two of the containers 11 to be cleaned are individually disposed in inverted relation over each of the brush assemblies 85, as shown in FIG. 4. Each container is forced downwardly about its respective first brush 86 and disposed so that the annular lip 17 of the container engages the bristles 99 of the second brush 96. Thus, as can be seen in FIG. 7, the bristles 93 and 94 of the first brush engage the interior surfaces 15 and 13 respectively of the container. Similarly, the bristles 99 of the second brush 96 engage the annular lip 17 of the container. The spring members 101 engage the exterior surface 16 of their respective container.

Each clamping assembly 104 is subsequently operated to retain its respective container in the described position on the brush assembly 85 during operation of the apparatus 10. This is accomplished by tightening the adjustment member 109 to draw the flanges 107 toward each other. This operates to reduce the size of the band 105 and to draw the spring members 101 more tightly into engagement with the container thereby locking it in nonrotational position on the brush assembly. The closure 56 is then positioned in the closed attitude shown in FIG. 1 to seal the receptacle 47 to reduce to an absolute minimum the risk of explosion or fire.

The electric motor 111 is plugged in using plug 113 and the motor is switched on by operating the foot lever 117 of the microswitch 116. The electric motor operates to drive the pump 119 by way of the drive belts 129 and 130. The pump 119 pumps the cleaning fluid from the receptacle 47 through the intake conduit 140, through the flexible conduit 147 and pipe 146, upwardly through the rotating unions 142, the tubular shafts 75 and into the central passage 90 of each first brush 86. The cleaning fluid is discharged under pressure as a spray outwardly through the spray bores 92 of the core 87 between the bristles 93 and 94.

Simultaneously, the gear box 125 is driven by the gear box drive belt 129. The gear box, in turn, rotates the tubular shafts 75 by means of the brush drive belt 132 and pulleys 131.

Rotation of the shafts 75 rotates the brush assemblies 85 to scrub the interior surfaces 13 and 15 of the containers 11 as the cleaning fluid is applied to the interior of the containers. It has been found in the case of paint and paint like substances that the combination of the rapid scrubbing action of the bristles 93 and 94 with the forceful application of the cleaning fluid, usually lacquer thinner, results in an almost instantaneous removal of the paint substances. Within a few seconds time and in some instances after a second or two of operation the interior surfaces of the containers are returned to an immaculate condition ready for reuse. Furthermore, the paint substances are simultaneously removed from the annular lips of the respective containers by the peripheral bristles 99 of the second brushes 96.

The cleaning fluid, bearing the substances which are removed, flows gravitationally out of the container and back to the level 160 of the fluid in the receptacle 47.

After the relatively short period of operation previously described, the operator again depresses the foot lever 117 of the microswitch 116 to shut off the motor 111. The closure 56 is then opened and the clean containers removed from the brush assemblies 85. The containers are expeditiously removed by simply turning the adjustment members 109 of the clamping assemblies 104 to loosen the bands 105 and then pulling the containers individually from their respective brush assemblies 85. It has been found that the apparatus 10 can be used repeatedly to clean a multiplicity of containers without changing the fluid within the receptacle. Several containers can be cleaned in this manner within as short a period of time as thirty seconds.

When it becomes necessary to remove the cleaning fluid from the receptacle 47 the faucet 150 is operated, using the handle 151, to discharge the fluid from the receptacle. Much of the paint substances normally settles out of the fluid where lacquer or paint thinner is used. Furthermore, the paint substances are more viscous than the thinner and in some instances in particulate form. As a result, the operator can draw off the cleaning fluid for reuse if desired while leaving the paint substances within the receptacle to be cleaned out by conventional means thereafter.

Since the apparatus 10 is preferably constructed of aluminum wherever possible, utilizes a spark or explosion proof motor and retains the cleaning fluid in a sealed environment, the risk of explosion and fire is virtually eliminated. Additionally, the components of the apparatus which are in direct contact with the fluid are preferably constructed of corrosion proof materials. Similarly the bearings 62, as previously noted, are sealed so as to prevent contact of the fluid with internal structures subject to such damage. Therefore, corrosive fluids such as paint and lacquer thinner can be employed in the apparatus over a long operational life without damage to the apparatus.

Therefore, the cleaning apparatus of the present invention constitutes a rapid, efficient, safe and fully dependable means for cleaning containers of a wide variety of types and particularly paint containers using flamable fluids without causing undue wear to the apparatus and thereby making reuse of such containers feasible.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An apparatus for cleaning containers using a flamable fluid, the apparatus comprising a rigid frame adapted for use in a predetermined attitude; a platform mounted on the frame; a tank for the receipt of the flamable fluid borne by the frame in spaced relation to the platform and composed of a plurality of side walls defining an internal receptacle with an entrance opening facing upwardly when the frame is in said predetermined attitude and a floor united with the side walls in fluid tight relation and sloped, when the frame is in said attitude, downwardly to one of said side walls; a shaft mounting assembly secured to fluid tight, upright relation on said floor of the tank and extending from a lower end adjacent to the floor to an upper end disposed within said receptacle of the tank; a tubular shaft mounted for rotational movement within the mounting assembly and extending endwardly of the upper and lower ends of the mounting assembly; a brush assembly affixed on the portion of the shaft adjacent to said upper end of the mounting assembly; means borne by the upper end of the mounting assembly for releasably holding a container to be cleaned in inverted relation about the brush assembly; a drive motor mounted on said platform; a fluid pump borne by the platform and having an intake conduit extending through the floor of the tank to an intake end in spaced relation to said floor; a drive assembly connected in rotationally driving relation to the tubular shaft; a supply conduit assembly interconnecting the pump and the shaft in fluid supplying relation; and means linking the drive motor with said pump and said drive assembly for driving the drive assembly from the motor to rotate the tubular shaft and brush assembly borne thereby and for operating the pump to draw flamable fluid from within the receptacle of the tank and force it through the supply conduit assembly, tubular shaft and outwardly from the brush assembly whereby a container held on the brush assembly is cleaned by the rotation of said brush assembly thereagainst and said fluid.

2. The apparatus of claim 1 wherein a closure is mounted on the tank for selective sealing of the entrance opening thereof to preclude the escape of the flamable fluid from the tank during operation of the apparatus.

3. The apparatus of claim 2 wherein a faucet assembly is mounted on the side wall of the tank to which the floor slopes adjacent to said floor to permit drawing off of the volatile fluid while leaving substantially all of the substances cleaned from the tank therewithin for subsequent removal.

4. The apparatus of claim 3 wherein the holding means includes a substantially circular band having opposite ends interconnected by an adjustment member operable to move said opposite ends relative to each other thereby selectively to capture a container within the band on the brush assembly.

5. An apparatus for cleaning a container having a substantially cylindrical side wall with an exterior surface, an interior surface bearing paint, lacquer or the like, a bottom wall and an annular lip bounding an opening remote from the bottom wall, the apparatus comprising a brush having a longitudinal axis and dimensioned to be received in the container extending substantially between the bottom wall and the lip and in engagement with the interior surface of the side wall at the time of insertion; means for rotating the brush about its longitudinal axis; more than two elongated members borne by the apparatus substantially equally spaced from each other to receive said container between the members when the brush is received in the container; means for urging said members toward the longitudinal axis of the brush and into engagement with the exterior surface of the side wall extending more than half the distance between the bottom wall to the lip to mount said container in fixed position in axial alignment with the longitudinal axis of the brush; and means for supplying a solvent to the interior surface of the container.

6. The apparatus of claim 5 wherein a second brush is borne by the apparatus for rotation with said first brush and positioned for engagement with the annular lip of the container when the first brush engages the interior surface of the container.

7. The apparatus of claim 5 wherein the solvent is a flammable fluid and the apparatus has a housing enclosing the container, brushes and solvent supplying means during rotation of the brushes and supplying of the solvent to minimize the risk of fire or explosion.

* * * * *

UNITED STATES PATENT AND TRADEMARK OFFICE

CERTIFICATE OF CORRECTION

PATENT NO. : 4,115,891

DATED : September 26, 1978

INVENTOR(S) : Robert N. Wills

It is certified that error appears in the above-identified patent and that said Letters Patent are hereby corrected as shown below:

In the Abstract, line 8, delete "enwardly" and insert

---endwardly---.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*